US011489308B2

(12) United States Patent
Gu et al.

(10) Patent No.: US 11,489,308 B2
(45) **Date of Patent: *Nov. 1, 2022**

(54) METHOD FOR MANUFACTURING POWER PIN OF POWER INTERFACE WITHOUT REMOVING BURRS

(71) Applicant: GUANGDONG OPPO MOBILE TELECOMMUNICATIONS CORP., LTD., Guangdong (CN)

(72) Inventors: Guodong Gu, Dongguan (CN); Feifei Li, Dongguan (CN)

(73) Assignee: GUANGDONG OPPO MOBILE TELECOMMUNICATIONS CORP., LTD., Guangdong (CN)

( * ) Notice: Subject to any disclaimer, the term of this patent is extended or adjusted under 35 U.S.C. 154(b) by 740 days.

This patent is subject to a terminal disclaimer.

(21) Appl. No.: 16/305,688

(22) Filed: Nov. 29, 2018

(65) Prior Publication Data

US 2019/0288471 A1 Sep. 19, 2019

Related U.S. Application Data

(63) Continuation of application No. PCT/CN2017/081270, filed on Apr. 20, 2017.

(30) Foreign Application Priority Data

Jul. 27, 2016 (CN) ..... 201610605734.1

(51) Int. Cl.
*H01R 43/16* (2006.01)
*H01R 13/02* (2006.01)
(Continued)

(52) U.S. Cl.
CPC ..... *H01R 43/16* (2013.01); *B21D 28/16* (2013.01); *H01R 13/02* (2013.01); *H01R 24/60* (2013.01); *H01R 43/24* (2013.01); *H01R 2107/00* (2013.01)

(58) Field of Classification Search
CPC .... H01R 43/16; H01R 43/24; H01R 2107/00; H01R 24/60; H01R 13/02;
(Continued)

(56) References Cited

U.S. PATENT DOCUMENTS 3,071,844 A * 1/1963 Krause ..... B21K 1/44 29/874
5,163,223 A 11/1992 Wurster
(Continued)

FOREIGN PATENT DOCUMENTS

CN 1209910 A 3/1999
CN 1237020 A 12/1999
(Continued)

OTHER PUBLICATIONS

Zhaoguo Hu et al., The study of the stamping process and mold design of data interface part, Modern Manufacturing Engineerin, Aug. 2012, 96-100, ISSN:1671-3133, China.
(Continued)

*Primary Examiner* — Minh N Trinh
(74) *Attorney, Agent, or Firm* — Ladas & Parry, LLP

(57) ABSTRACT

A method for manufacturing a power pin of a power interface is provided. The method may includes the steps of: providing a pin workblank, wherein the pin workblank includes a first surface and a second surface adjacent to each other; performing a fine blanking process for the first surface in a predetermined blanking direction, while burrs forming on the second surface; and adjusting a position of the pin workblank, performing another fine blanking process for the
(Continued)

second surface in the predetermined blanking direction, to form a power pin of the power interface and to omit a process of removing the burrs on the second surface. Before the step of adjusting a position of the pin workblank, the method further includes a step of forming a chamfer or a round fillet at an edge of the second surface adjacent to the first surface of the pin workblank.

15 Claims, 8 Drawing Sheets

(51) Int. Cl.

| | |
|---|---|
| ***H01R 24/60*** | (2011.01) |
| ***H01R 43/24*** | (2006.01) |
| ***B21D 28/16*** | (2006.01) |
| ***H01R 107/00*** | (2006.01) |

(58) Field of Classification Search
CPC ..... Y10T 29/49208; Y10T 29/49204; Y10T 29/4922; Y10T 29/49222; B21D 28/16; B21D 28/34
USPC ..... 29/874, 876, 883, 884
See application file for complete search history.

(56) References Cited

U.S. PATENT DOCUMENTS

| | | | | |
|---|---|---|---|---|
| 5,259,111 | A | 11/1993 | Watanabe | |
| 6,304,455 | B1 | 10/2001 | Huber et al. | |
| 6,997,727 | B1 | 2/2006 | Legrady et al. | |
| 7,030,325 | B2 | 4/2006 | Biossfeld et al. | |
| 8,910,549 | B2 | 12/2014 | Grimm | |
| 9,537,261 | B2 | 1/2017 | Chen et al. | |
| 9,692,166 | B2 | 6/2017 | Kao et al. | |
| 10,720,743 | B2 * | 7/2020 | Gu | H01R 13/02 |
| 2010/0015864 | A1 | 1/2010 | Zaitsu | |
| 2014/0134887 | A1 | 5/2014 | Soubh et al. | |
| 2015/0380884 | A1 | 12/2015 | Lee et al. | |
| 2016/0006195 | A1 * | 1/2016 | Zhao | H01R 13/504 439/676 |
| 2016/0099526 | A1 | 4/2016 | Chen | |
| 2016/0134055 | A1 | 5/2016 | Chen et al. | |
| 2016/0134056 | A1 | 5/2016 | Chen et al. | |
| 2018/0358736 | A1 | 12/2018 | Gu et al. | |
| 2019/0165537 | A1 * | 5/2019 | Li | B21D 28/16 |
| 2019/0288471 | A1 * | 9/2019 | Gu | H01R 43/24 |

FOREIGN PATENT DOCUMENTS

| | | | |
|---|---|---|---|
| CN | 201072837 | Y | 6/2008 |
| CN | 103199357 | A | 7/2013 |
| CN | 104362451 | A | 2/2015 |
| CN | 103199357 | B | 6/2015 |
| CN | 104882705 | A | 9/2015 |
| CN | 205282692 | U | 6/2016 |
| CN | 106025769 | A | 10/2016 |
| CN | 106099459 | A | 11/2016 |
| CN | 106229791 | A | 12/2016 |
| CN | 205960248 | U | 2/2017 |

OTHER PUBLICATIONS

Written opinion of the International Searching Authority for PCT/CN2017/081270 with Google machine translation, dated Jul. 27, 2017.
International Search Report for PCT/CN2017/081270 with English Translation from WIPO, dated Jul. 27, 2017.
European examination report,EP17833262.3, dated Mar. 24, 2021(5 pages).
First Office Action from China patent office in a counterpart China publication No. CN201610605734.1, dated Jul. 31, 2017, with its machine English translation by Global Dossier.
From PCT/CN2017/081270, Written Opinion of the International Searching Authority, dated Jul. 27, 2017, with English translation from WIPO.
From PCT/CN2017/081270, International Preliminary Report on Patentability, dated Jan. 29, 2019, with English translation from WIPO.
Non Final Action from United States Patent and Trademark Office in a counterpart U.S. Appl. No. 16/439,306, dated Jan. 17, 2020 (11 pages).
First Office Action from India patent office in a counterpart India patent Application 201917004743, dated Feb. 27, 2020 (6 pages).
European search report, EP17833262, dated Oct. 14, 2019 (10 pages).

* cited by examiner

METHOD FOR MANUFACTURING POWER PIN OF POWER INTERFACE WITHOUT REMOVING BURRS

CROSS REFERENCE TO RELATED APPLICATIONS

The present application is a continuation-application of International (PCT) Patent Application No. PCT/CN2017/081270 filed Apr. 20, 2017, which claims foreign priorities of Chinese Patent Application No. 201610605734.1, filed on Jul. 27, 2016, the entire contents of which are hereby incorporated by reference in their entireties.

TECHNICAL FIELD

The present disclosure relates to the technical field of the communication technology, and in particular to a mobile terminal, a power interface, and a method for manufacturing the power interface.

BACKGROUND

With the advancement of times, the Internet and the mobile communication network provide a huge number of functional applications. Users may use mobile terminals not only for traditional applications, for example, using smart phones to answer or make calls, but also for browsing webs, transferring pictures, playing games, and the like at the same time.

While using mobile terminals to handle things, due to the increase in frequencies of using the mobile terminals, it will consume a large amount of powers of batteries the mobile terminals, such that the batteries need to be charged frequently. Furthermore, due to the acceleration of the pace of life, especially the increasing of sudden and urgencies, the users hopes that the batteries of the mobile terminals are charged with a large current.

DETAILED DESCRIPTION

Figure 1:
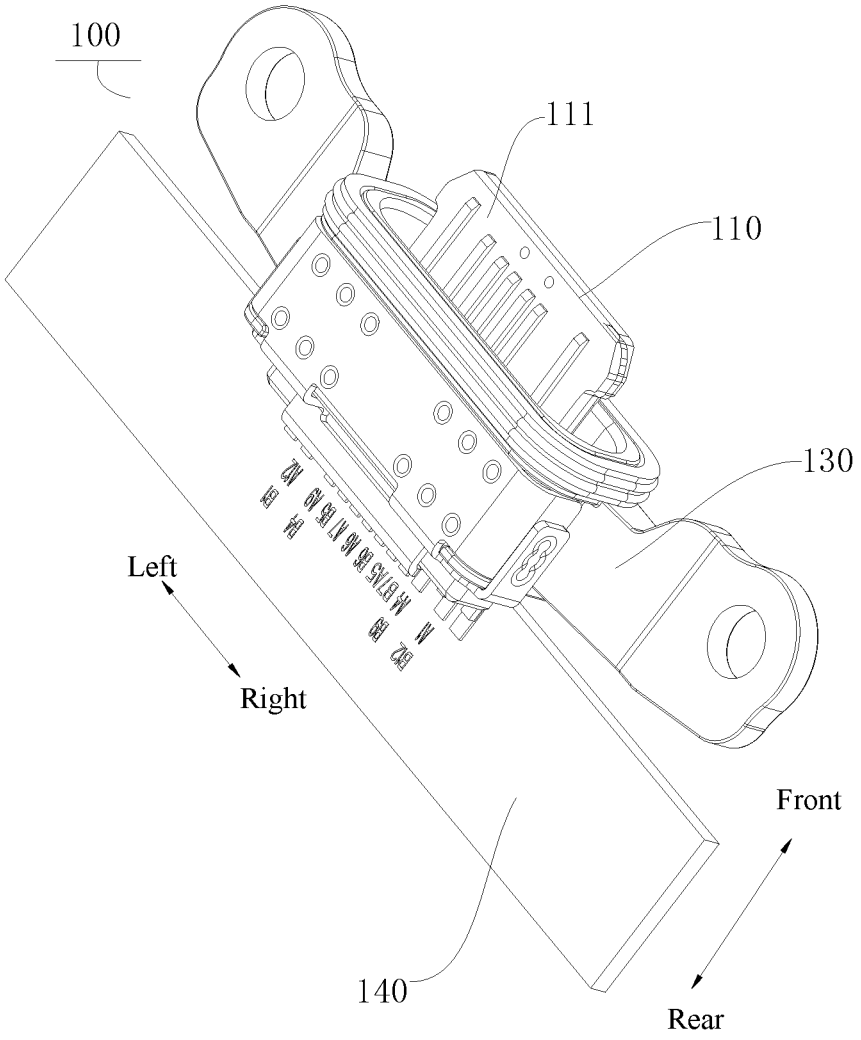
FIG. 1 is a perspective view of a power interface according to an embodiment of the present disclosure.
Figure 2:
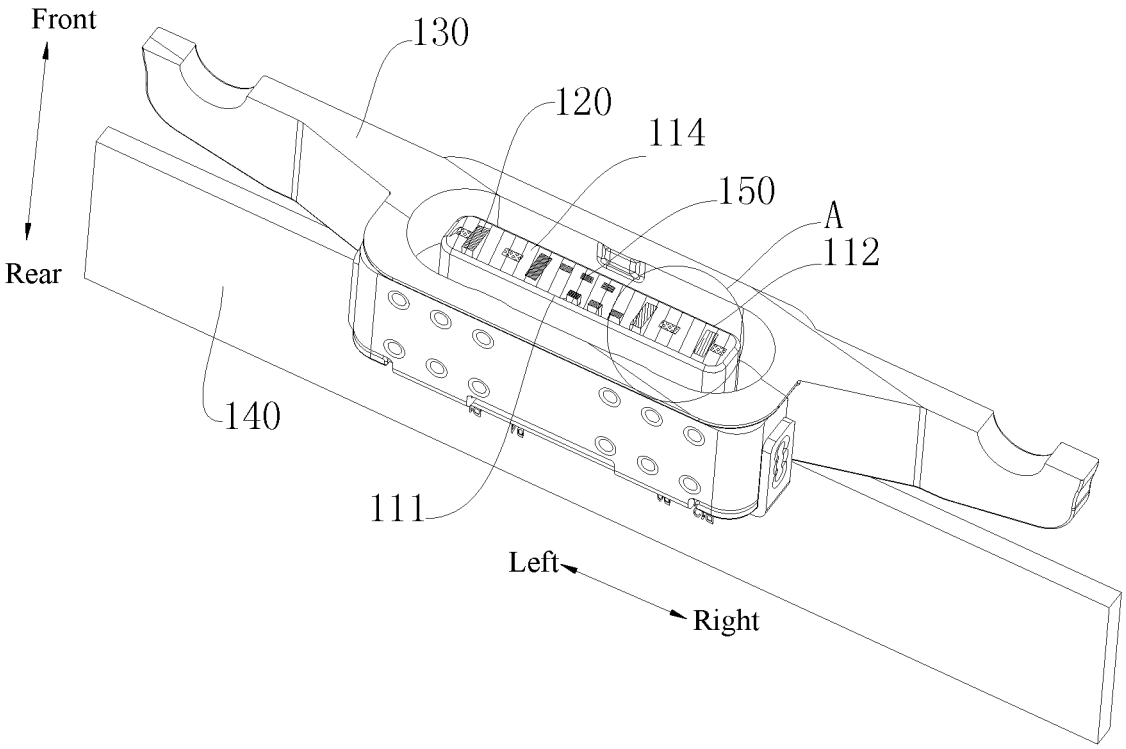
FIG. 2 is a cutaway view of the power interface according to an embodiment of the present disclosure.

Embodiments of the present disclosure will be described in detail below, and examples of the embodiments will be illustrated in the accompanying drawings. The embodiments described below with reference to the drawings are illustrative and are intended to explain the present disclosure, and cannot be construed as a limitation to the present disclosure.

In the description of the present disclosure, it is to be understood that terms such as "upper", "lower", "front", "rear", "left", "right", "upright", "horizontal", "top", "bottom", "inner", "outer", "circumference", and the like, refer to the orientations and locational relations illustrated in the accompanying drawings. Thus, these terms used here are only for describing the present disclosure and for describing in a simple manner, and are not intended to indicate or imply that the device or the elements are disposed to locate at the specific directions or are structured and performed in the specific directions, which could not to be understood as limiting the present disclosure.

In addition, terms such as "first", "second", and the like are used herein for purposes of description, and are not intended to indicate or imply relative importance or significance or to imply the number of indicated technical features. Thus, the feature defined with "first", "second", and the like may include one or more of such a feature. In the description of the present disclosure, "a plurality of" means two or more, such as two, three, and the like, unless specified otherwise.

In the present disclosure, unless specified or limited, otherwise, terms "mounted", "connected", "coupled", "fixed", and the like are used in a broad sense, and may include, for example, fixed connections, detachable connections, or integral connections; may also be mechanical or electrical connections; may also be direct connections or indirect connections via intervening structures; may also be inner communications of two elements, as can be understood by one skilled in the art depending on specific contexts.

A power interface 100 according to an embodiment of the present disclosure may be described in detail below with reference to FIGS. 1-14. It should be noted that, the power interface 100 may include an interface configured for charging or data transmission, and may be disposed in a mobile terminal such as a mobile phone, a tablet computer, a laptop computer, or any other suitable mobile terminals having a rechargeable function. The power interface 100 may be electrically connected to a corresponding power adapter to achieve a communication of electrical signals and data signals.

Referring to FIGS. 1-6, the power interface 100 may include a connection body 110 and a plurality of power pins 120.

More specifically, the connection body 110 may include a first connection surface 111 and a second connection surface 112. Each of the first connection surface 111 and the second connection surface 112 may be adapted to be electrically connected with a corresponding interface of the power adapter. The plurality of the power pins 120 may be embedded in the connection body 110. Each power pin 120 may include a first sidewall surface 121 and a second sidewall surface 122. The first sidewall surface 121 may be configured as a part of the first connection surface 111, and the second sidewall surface 122 may be configured as a part of the second connection surface 112. In other words, the first sidewall surface 121 may extend beyond and be exposed outside the connection body 110, so as to be configured as a part of the first connection surface 111, thereby facilitating each power pin 120 to electrically connect to a corresponding pin of the power adapter. Likewise, the second sidewall surface 122 may extend beyond and be exposed outside the connection body 110, so as to be configured as a part of the second connection surface 112, thereby facilitating each power pin 120 to electrically connect to a corresponding pin of the power adapter.

Figure 3:
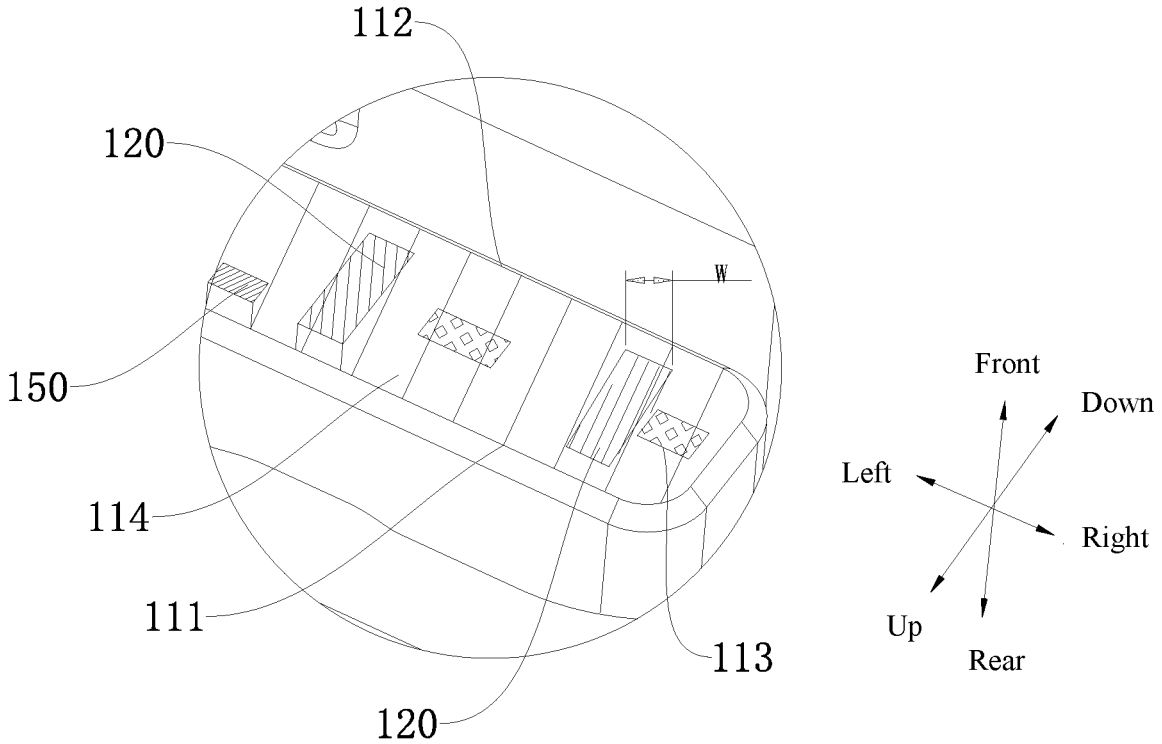
FIG. 3 is a partially enlarged view of portion A of FIG. 2.
Figure 5:
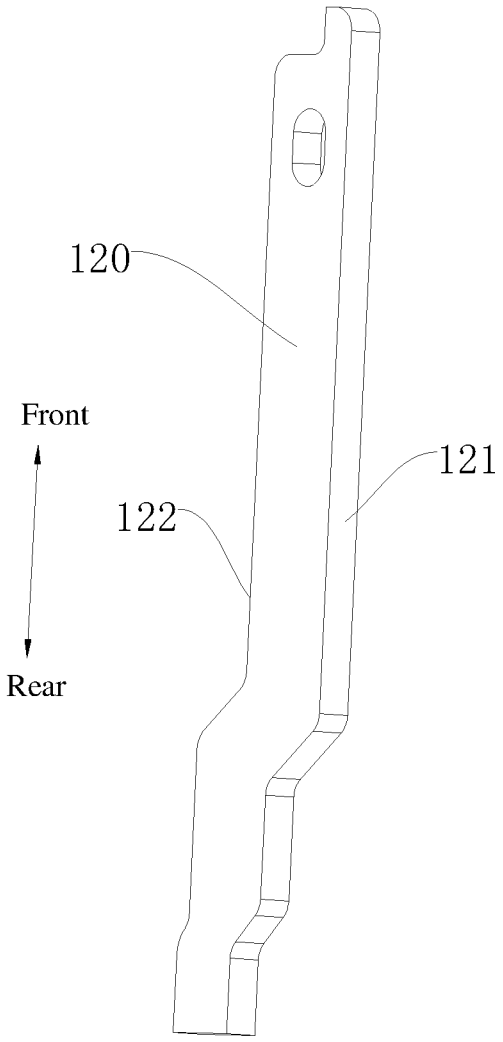
FIG. 5 is a perspective view of the power pin according to an embodiment of the present disclosure.

In the related art, pins of the power interface includes two rows of pins that are arranged in an up-down direction, and each row of pins includes a plurality of pins spaced from each other. The pins in the upper row are respectively opposite to the pins in the lower row. It can be understood that, in the power interface 100 in this embodiment, as shown in FIG. 3, two power pins opposite to each other in the up-down direction in the related art are designed into one integrated power pin 120, and two sidewall surfaces of the integrated power pin 120 are respectively configured as the parts of the connection surfaces adapted to be electrically connected to the power adapter. In other words, in the power interface 100 of this embodiment, as shown in FIG. 5, each power pin 120 is solid, that is, the portion of each power pin 120 between the first sidewall surface 121 and the second sidewall surface 122 is a solid structure. The first sidewall surface 121 and the second sidewall surface 122 of each power pin 120 are exposed outside the power interface 100 to be used as an electrically-connecting piece for being electrically connected to a power adapter (which achieve the function similar with that of the two independent power pins opposite to each other in the up-down direction). Thus, the cross-sectional area of each power pin 120 can be increased, thereby increasing the current-carrying amount of each power pin 120, and in turn increasing the transmission speed of the current, such that the power interface 100 is capable of having a fast charging function, and thus the charging efficiency of the battery may be improved.

According to the power interface 100 of one embodiment of the present disclosure, the first sidewall surface 121 and the second sidewall surface 122 of each power pin 120 are configured as the connection surfaces adapted to be electrically connected to the power adapter. Thus, the cross-sectional area of each power pin 120 can be increased, thereby increasing the current-carrying amount of each power pin 120, and in turn increasing the transmission speed of the current, such that the power interface 100 is capable of having a fast charging function, and thus the charging efficiency of the battery may be improved.

Figure 4:
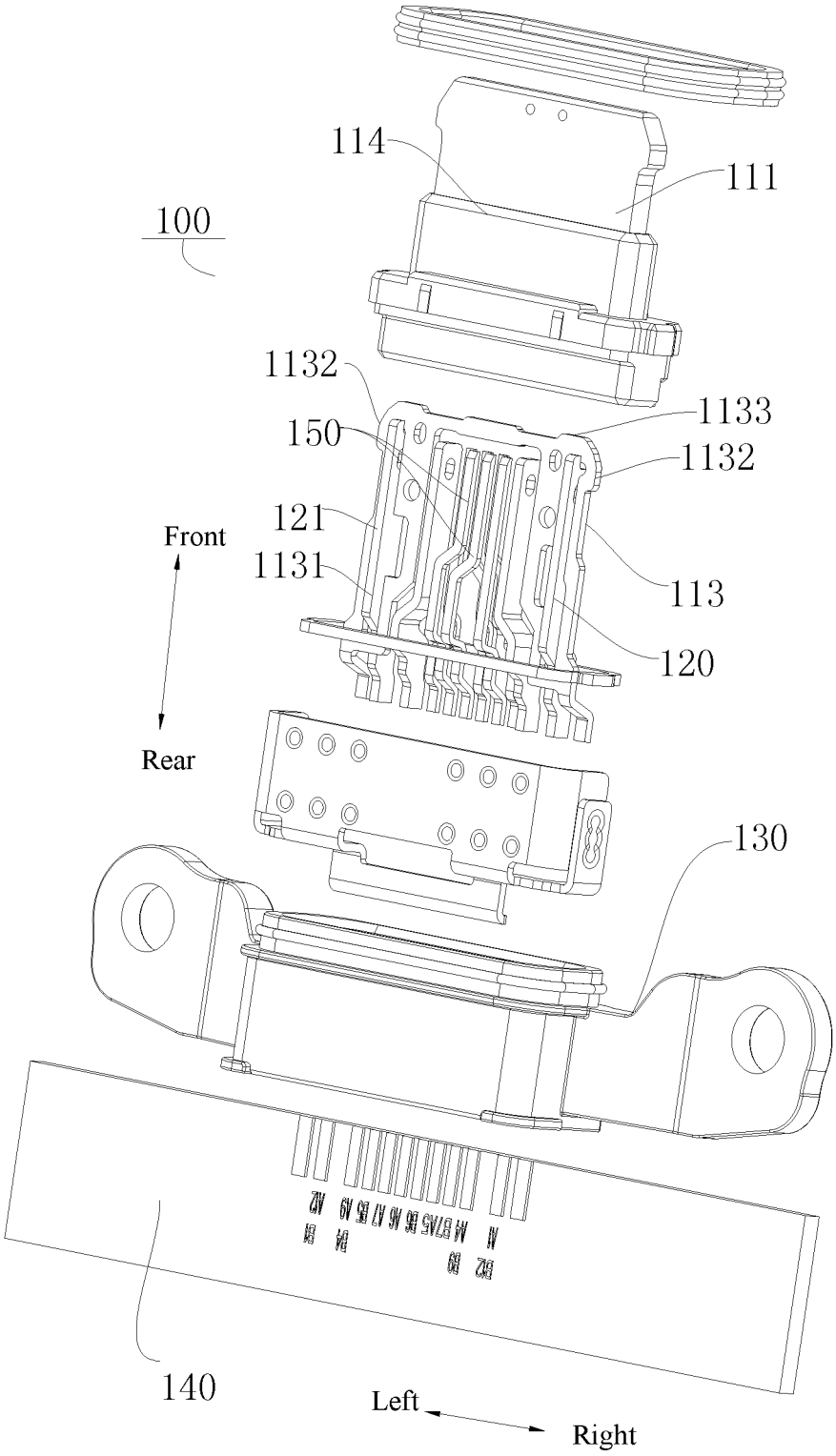
FIG. 4 is an explored view of the power interface according to an embodiment of the present disclosure.
Figure 6:
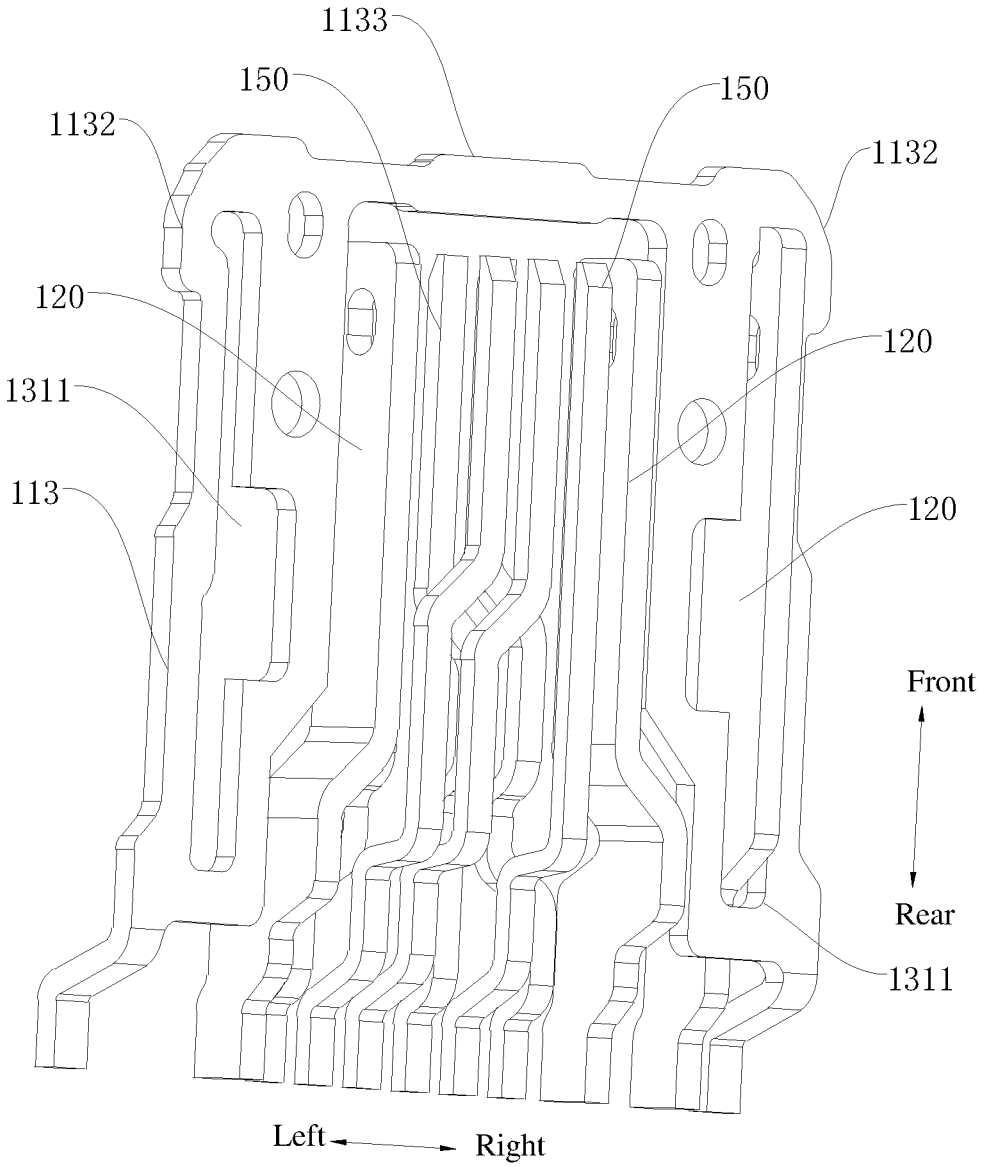
FIG. 6 is partial view of the power pin according to an embodiment of the present disclosure.

According to an embodiment of the present disclosure, as shown in FIGS. 4-6, the connection body 110 may include a hard frame 113 and a plastic encapsulation portion 114. More specifically, the hard frame 113 may define a plurality of receiving grooves 1131, and the plurality of power pins 120 may be arranged in the receiving grooves 1131 respectively. The plastic encapsulation portion 114 may be configured to wrap the plurality of power pins 120 and the hard frame 113. The first sidewall surface 121 and the second sidewall surface 122 may be exposed outside the plastic encapsulation portion 114. It can be understood that, by using the plastic encapsulation portion 114 to wrap the power pin 120 and the hard frame 113 together, the structural strength of the connection body 110 can be enhanced. In this way, fatigue damage to the connection body 110 due to the repeated insertion and removal of the power interface 100 may be reduced. The hard frame 113 may serve as a support, such that the structural strength of the connection body 110 may be enhanced.

As shown in FIG. 4 and FIG. 6, according to an embodiment of the present disclosure, the hard frame 113 may include a protrusion 1132 disposed respectively at each of two ends that are spaced from each other in the width direction (the left and right direction as shown in FIGS. 4 and 6). An end surface of a free end of the protrusion 1132 may be configured as a part of an outer surface of the plastic encapsulation portion 114. In this way, when the power interface 100 is connected to the power adapter, the protrusion 1132 may apply a pressure to the power adapter, such that the power interface 100 and the power adapter may be firmly connected to each other, and the stability and reliability of the connection between the power interface 100 and the power adapter may be improved. Further, as shown in FIG. 6, the protrusion 1132 may be located at the front end 1133 of the hard frame 113.

According to an embodiment of the present disclosure, a cross-sectional area of each power pin 120 may be defined as S, and $S \geq 0.09805\ mm^2$. It is proved by experiments that when $S \geq 0.09805\ mm^2$, the current-carrying amount of the plurality of power pins 120 is at least 10 A, and the charging efficiency can be improved by increasing the current-carrying amount of the plurality of power pins 120. In other words, when the cross-sectional area S of each power pin 120 satisfies: $S \geq 0.09805\ mm^2$, each power pin 120 may bear a current not less than 10 A, that is, each power pin 120 may bear a large charging current and the large charging current won't damage each power pin 120. It is proved by experiments that when $S=0.13125\ mm^2$, the current-carrying amount of the plurality of power pins 120 is at least 12 A, which can improve the charging efficiency. In other words, when the cross-sectional area S of each power pin 120 satisfies: $S=0.13125\ mm^2$, each power pin 120 may bear a current not less than 12 A.

Figure 16:
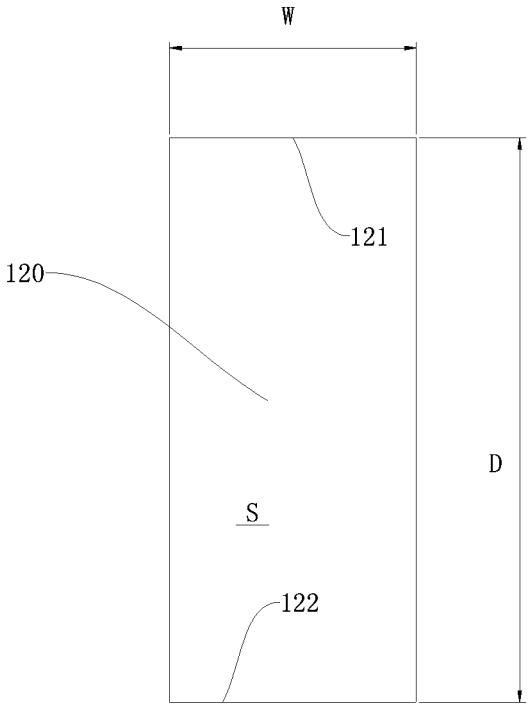
FIG. 16 is a structural view of the power pin of the power interface according to an embodiment of the present disclosure.

According to an embodiment of the present disclosure, referring to FIG. 16, a distance between the first sidewall surface 121 and the second sidewall surface 122 may be defined as D, and D satisfies the condition that: $D \leq 0.7$ mm. That is, a thickness of the power pin 120 may be defined as D, and D satisfies the condition that: $D \leq 0.7$ mm. Herein, the "thickness" may refer to the width of each power pin 120 in the up-down direction as shown in FIG. 3.

It should be noted that, in order to improve the universality of the power interface 100, the structural design of the power interface 100 needs to meet certain design standards. For example, in the design standard of the power interface 100, if the maximum thickness of the power interface 100 is h, then during the designing process of the power pins 120, the thickness D of each power pin 120 needs to be equal to or less than h. In the condition that $D \leq h$, the greater the thickness D of each power pin 120 is, the greater the amount of current that each power pin 120 can carry, and the higher the charging efficiency of the power interface 100 is. That is, the thickness D of each power pin 120 which is between the first sidewall surface 121 and the second sidewall surface 122 may be substantially same to the thickness h of the power interface 100. For example, taking an USB Type-C interface as an example, the design standard for the thickness of the USB Type-C interface is h=0.7 mm. Thus, when designing the power interface 100, it is required to set D≤0.7 mm. Therefore, not only the power interface 100 can meet the general requirements, but also the cross-sectional area of each power pin 120 can be increased in comparison with the related art. In this way, the current-carrying amount of the plurality of power pins 120 can be increased, thereby improving the charging efficiency.

According to an embodiment of the present disclosure, at least one of the plurality of power pins 120 has a width W satisfying the following condition: 0.24 mm≤W≤0.32 mm. It is proved by experiments that when 0.24 mm≤W≤0.32 mm, the cross-sectional area of each power pin 120 can be maximized, which may in turns increase the current-carrying amount of the plurality of power pins 120, thereby improving the charging efficiency. Alternatively, it is possible that W=0.25 mm. It is proved by experiments that when W=0.25 mm, the current-carrying amount of the plurality of power pins 120 is at least 10 A. Thus, the charging efficiency may be improved by increasing the current-carrying amount of the plurality of power pins 120.

According to an embodiment of the present disclosure, each power pin 120 may be an one-piece component. In this way, on one hand, it is possible to simplify the processing of each power pin 120, shorten the production cycle, and save the manufacturing cost. On the other hand, it is also possible to increase the cross-sectional area of each power pin 120, thereby increasing the current-carrying amount of the plurality of power pins 120.

The power interface 100 according to an embodiment of the present disclosure will be described in detail with reference to FIGS. 1-6 and 14 below. It is to be understood that the following description is illustrative, and is not intended limit the present disclosure.

For convenience of description, a Type-C interface is taken as an example of the power interface 100. The Type-C interface may also be called an USB Type-C interface. The Type-C interface belongs to a type of an interface, and is a new data, video, audio and power transmission interface specification developed and customized by the USB standardization organization to solve the drawbacks present for a long time that the physical interface specifications of the USB interface are uniform, and that the power can only be transmitted in one direction.

The Type-C interface may have the following features: a standard device may declare its willing to occupy a VBUS (that is, a positive connection wire of a traditional USB) to another device through a CC (Configuration Channel) pin in the interface specification. The device having a stronger willing may eventually output voltages and currents to the VBUS, while the other device may accept the power supplied from the VBUS bus, or the other device may still refuse to accept the power; however, it does not affect the transmission function. In order to use the definition of the bus more conveniently, a Type-C interface chip (such as LDR6013) may generally classify devices into four types: DFP (Downstream-facing Port), Strong DRP (Dual Role Power), DRP, and UFP (Upstream-facing Port). The willingness of these four types to occupy the VBUS bus may gradually decrease.

In this embodiment, the DFP may correspond to an adapter, and may continuously want to output voltages to the VBUS. The Strong DRP may correspond to a mobile power, and may give up outputting voltages to the VBUS only when the strong DRP encounters the adapter. The DRP may correspond to a mobile phone. Normally, the DRP may expect other devices to supply power to itself. However, when encountering a device that has a weaker willingness, the DRP may also output the voltages and currents to the device. The UFP will not output electrical power externally. Generally, the UFP is a weak battery device, or a batteryless device, such as a Bluetooth headset. The USB Type-C interface may support the insertions both from a positive side and a negative side. Since there are four groups of power sources and grounds on both sides (the positive side and the negative side), the power supported by USB Type-C interface may be greatly improved.

In this embodiment, the power interface 100 thereof may be the USB Type-C interface. The power interface 100 may be suitable for a power adapter having a fast charging function, and also suitable for an ordinary power adapter. Here, it should be noted that, the fast charging may refer to a charging state in which the charging current is greater than or equal to 2.5 A, or a charging state in which the rated output power is no less than 15 W. The ordinary charging may refer to a charging state in which the charging current is less than 2.5 A, or the rated output power is less than 15 W. That is, when the power interface 100 is charged by using the power adapter having the fast charging function, the charging current is greater than or equal to 2.5 A, or the rated output power is no less than 15 W. However, when the power interface 100 is charged by using the ordinary power adapter, the charging current is less than 2.5 A, or the rated output power is less than 15 W.

In order to standardize the power interface 100 and the power adapter adapted to the power interface 100, the size of the power interface 100 needs to meet the design requirements of the standard interface. For example, for the power interface 100 having 24 pins, the width meeting the design requirements (the width refers to the length of the power interface 100 in the left-right direction as shown in FIG. 1) is a. In order to make the power interface 100 in the present embodiment satisfy the design standard, the width of the power interface 100 in the present embodiment (the width refers to the length of the power interface 100 in the left-right direction as shown in FIG. 1) is also a. In order to enable the power pin to carry a large charging current in a limited space, a pair of opposite power pins spaced from each other in the up-down direction may be integrated with each other to form an one-piece power pin described in the present disclosure. In this way, on one hand, it is convenient to optimize the arrangement of the components of the power interface 100. On the other hand, the cross-sectional area of the power pin may be increased, such that the power pin 120 may carry a larger amount of current.

More specifically, as shown in FIGS. 1-6, the power interface 100 may include a plug housing 130, a connection body 110, a plurality of data pins 150, and a plurality of power pins 120.

The plug housing 130, the data pins 150, and the power pins 120 may be all coupled to the circuit board 140. The connection body 110 may include a hard frame 113 and a plastic encapsulation portion 114. The hard frame 113 may have a plurality of receiving grooves 1131. The power pins 120 and the data pins 150 may be disposed in the corresponding receiving grooves 1131. The plastic encapsulation portion 114 may be configured to wrap the power pins 120 and the hard frame 113. Upper and lower sidewall surfaces of the plastic encapsulation portion 114 may be respectively configured as a first connection surface 111 and a second connection surface 112. Both the first connection surface 111 and the second connection surface 112 may be adapted to be electrically connected to corresponding interfaces of the power adapter. The power pin 120 may include a first sidewall surface 121 and a second sidewall surface 122. The first sidewall surface 121 and the second sidewall surface 122 may be exposed outside the plastic encapsulation portion 114.

It can be understood that, by using the plastic encapsulation portion 114 to wrap the power pin 120 and the hard frame 113 together, the structural strength of the connection body 110 can be enhanced. In this way, fatigue damage to the connection body 110 due to the repeated insertion and removal of the power interface 100 may be reduced. The hard frame 113 may serve as a support, such that the structural strength of the connection body 110 may be enhanced.

The hard frame 113 may have protrusions 1132 respectively disposed at two ends of a front end of the hard frame 113 that are spaced from each other in the width direction (the left and right direction as shown in FIGS. 4 and 6). An end surface of a free end of each of the protrusions 1132 may be configured as a part of an outer surface of the plastic encapsulation portion 114. In this way, when the power interface 100 is connected to the power adapter, the protrusions 1132 may apply a pressure to the power adapter, such that the power interface 100 and the power adapter may be firmly connected to each other, and the stability and reliability of the connection between the power interface 100 and the power adapter may be improved.

Figure 14:
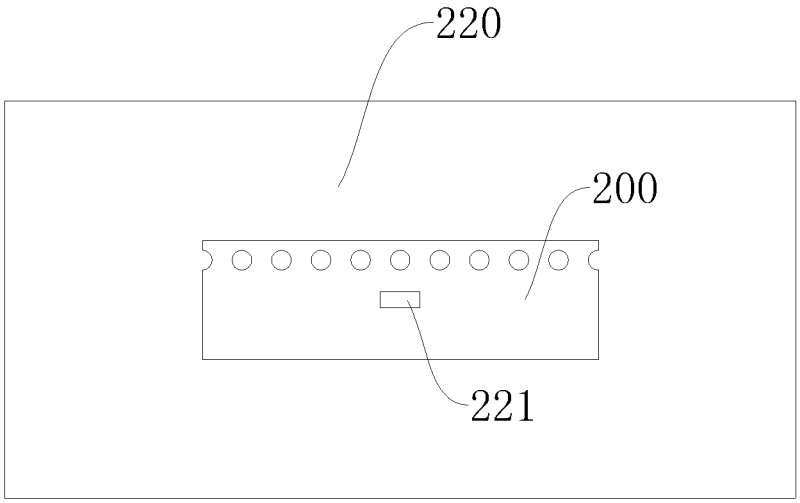
FIG. 14 is a perspective view of a tool suitable for the method for manufacturing the power interface according to an embodiment of the present disclosure.
Figure 15:
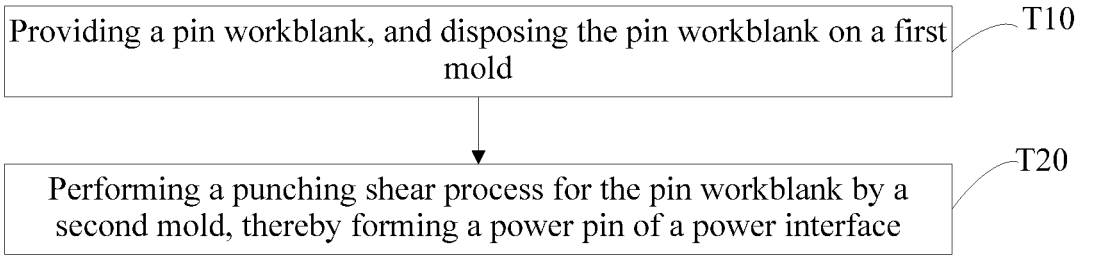
FIG. 15 is a flow chart illustrating the method for manufacturing the power interface according to an embodiment of the present disclosure.

As shown in FIGS. 3, 6, and 14, the width of the power pin 120 (here, the "width" may refer to the width of the power pin in the left-right direction as shown in FIG. 3) may be defined as W, a cross-sectional area of the power pin 120 may be defined as S, and a thickness of the power pin 120 may be defined as D. It is proved by experiments that when W=0.25 mm, S=0.175 $mm^2$, and D≤0.7 mm, the current-carrying amount of the power pin 120 may be greatly increased, and the charging efficiency may be improved. In this embodiment, the current-carrying amount of the power pin 120 may be 10 A, 12 A, 14 A or more, thereby improving the charging efficiency.

Therefore, the first sidewall surface 121 and the second sidewall surface 122 of the power pin 120 are configured as the connection surfaces adapted to be electrically connected to the power adapter. Thus, the cross-sectional area of the power pin 120 can be increased, thereby increasing the current-carrying amount of the power pin 120, and in turn increasing the transmission speed of the current, such that the power interface 100 is capable of having a fast charging function, and thus the charging efficiency of the battery may be improved.

Figure 7:
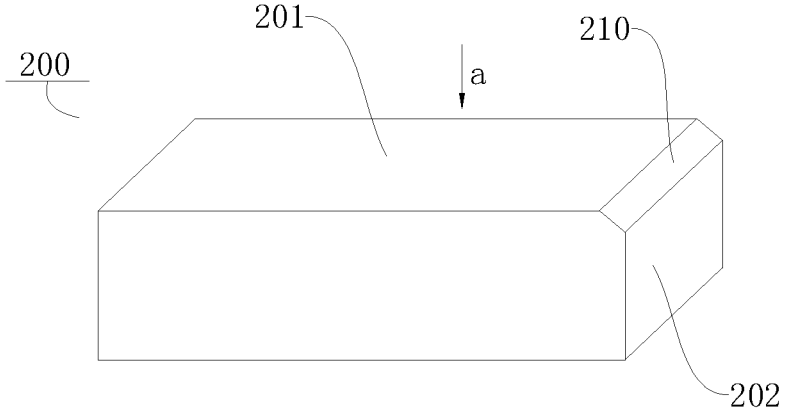
FIG. 7 is a stereogram of a pin workblank in a method for manufacturing a power interface according to an embodiment of the present disclosure.
Figure 8:
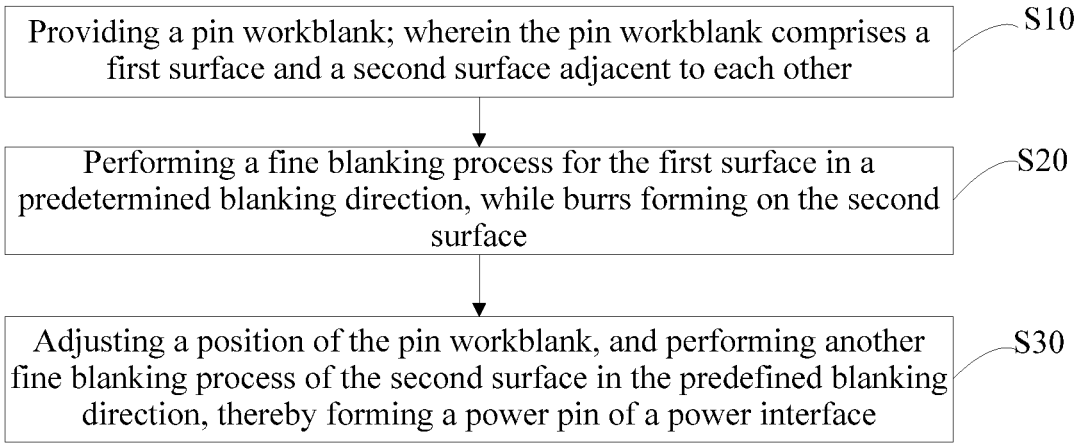
FIG. 8 is a flow chart illustrating the method for manufacturing the power interface according to an embodiment of the present disclosure.

As shown in FIGS. 7-8, a method for manufacturing a power interface 100 according to an embodiment of the present disclosure, may include the following blocks.

At block S10: providing a pin workblank 200. The pin workblank 200 may include a first surface 201 and a second surface 202 adjacent to each other.

At block S20: performing a fine blanking process for the first surface 201 in a predefined blanking direction (the direction indicated by the arrow a in FIG. 7) while burrs forming on the second surface 202.

At block S30: adjusting a position of the pin workblank 200, and performing another fine blanking process for the second surface 202 in the predefined blanking direction, thereby forming the power pin 120 of the power interface 100.

In the method for manufacturing the power interface 100 according to the embodiment of the present disclosure, different surfaces of the pin workblank 200 are processed by means of fine blanking. In this way, it is possible to not only improve the manufacturing accuracy of the power pin 120, but also omit the process of removing the burrs. Thus, the manufacturing cycle of the power interface may be shortened, and the manufacturing cost thereof may be saved.

In an embodiment of the present disclosure, the power interface 100 may be the power interface 100 described in the above embodiments.

Figure 9:
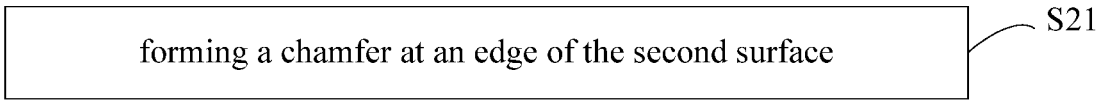
FIG. 9 is a flow chart illustrating a further block included in the method for manufacturing the power interface according to an embodiment of the present disclosure.

In an embodiment of the present disclosure, before the block S30, the method may further include the following block as shown in FIG. 9.

At block S21: forming a chamfer 210 at an edge of the second surface 202 as shown in FIGS. 7 and 9. It should be noted that, during the fine blanking process, excess materials may be easily accumulated at the edge of the pin workblank, thereby forming the burrs. By forming the chamfer 210 at the edge of the second surface 202, on one hand, it is possible to improve the surface smoothness of the power pin. On the other hand, during the fine blanking process, the excess materials may be filled into the chamfer 210, thereby reducing the occurrence of the burrs.

Figure 10:
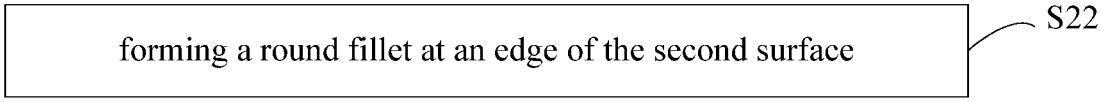
FIG. 10 is a flow chart illustrating another further block included in the method for manufacturing the power interface according to an embodiment of the present disclosure.

In another embodiment of the present disclosure, before the block S30, the method may further include the following block as shown in FIG. 10.

At block S22: forming a round fillet at an edge of the second surface 202 as shown in FIG. 10. That is, in the embodiment of the present disclosure, the chamfer 210 as shown in FIG. 7 may be replaced by the round fillet. It should be noted that, during the fine blanking process, excess materials may be easily accumulated at the edge of the pin workblank, thereby forming the burrs. By forming the round fillet at the edge of the second surface 202, on one hand, it is possible to improve the surface smoothness of the power pin. On the other hand, during the fine blanking process, the excess materials may be filled into the round fillet, thereby reducing the occurrence of burrs.

As described in the above, the power interface 100 may include the connection body 110 and a plurality of power pins 120, and the connection body 110 may include the hard frame 113 and the plastic encapsulation portion 114. Therefore, after forming the plurality of the power pins 120 each manufactured by the above steps S10~S30, the method may further include: embedding the plurality of the power pins 120 into the connection body 110, while the first sidewall surface 121 and the second sidewall surface 122 of each of the power pins 120 are exposed outside the connection body 110, such that the first sidewall surface 121 of each of the power pins 120 exposed outside the connection body 110 is configured as a part of the first connection surface 111 of the connection body 110, the second sidewall surface 122 of each of the power pins 120 exposed outside the connection body 110 is configured as a part of the second connection surface 112 of the connection body 110, and the first connection surface 111 and the second connection surface 112 of the connection body 110 are configured as connection surfaces of the power interface adapted to be electrically connected to the power adapter.

In detailed, the step of embedding the plurality of the power pins 120 into the connection body 110, may further include: arranging the plurality of the power pins 120 into the receiving grooves 1131 of the hard frame 113 respectively; and wrapping the plurality of the power pins 120 and the hard frame 113 together by the plastic encapsulation portion 114, while the first sidewall surface 121 and the second sidewall surface 122 of each of the power pins 120 are exposed outside the plastic encapsulation portion 114.

As shown in FIGS. 11-15, in a method for manufacturing a power interface 100 according to another embodiment of the present disclosure, the power interface 100 may be the power interface 100 as described above. The method may include the following blocks.

At block T10: providing a pin workblank 200, and disposing the pin workblank 200 on a first mold 220. In this embodiment, for conveniently positioning the pin workblank 200, the pin workblank 200 may have a plurality of positioning holes 203 formed therein.

At block T20: performing a punching shear process for the pin workblank 200 by a second mold 230, thereby forming the power pin of the power interface.

According to the manufacturing method of the power interface according to the present embodiment of the present disclosure, the power pin may be formed by means of the punching shear process. In this way, it is possible to omit the process of removing burrs. Thus, the manufacturing cycle may be shortened, and the manufacturing cost may be saved.

Referring to FIG. 14, in an embodiment of the present disclosure, a groove 221 may be formed in the first mold 220. On a plane substantially perpendicular to a punching-shear direction (the direction indicated by arrow b in FIG. 13), an outline of an orthographic projection area of the groove 221 may have a same shape and size as an outline of an orthographic projection area of the second mold 230. For example, on the plane substantially perpendicular to the punching-shear direction (the direction indicated by arrow b in FIG. 13), the outline of the orthographic projection area of the groove 221 may be in shape of a rectangle, and the outline of the orthographic projection area of the second mold 230 may also in shape of the rectangle, and the outline of the orthographic projection area of the groove 221 may be adapted to overlap with the outline of the orthographic projection area of the second mold 230.

Figure 11:
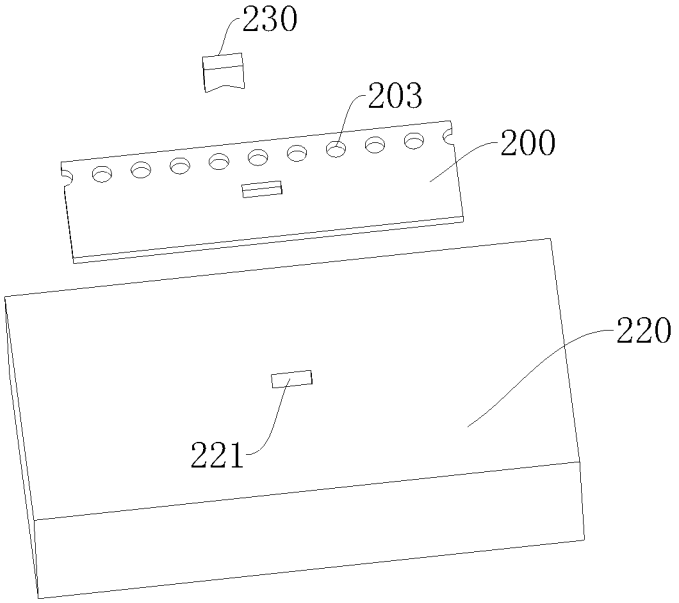
FIG. 11 is an explored view of a tool suitable for the method for manufacturing the power interface according to an embodiment of the present disclosure.
Figure 12:
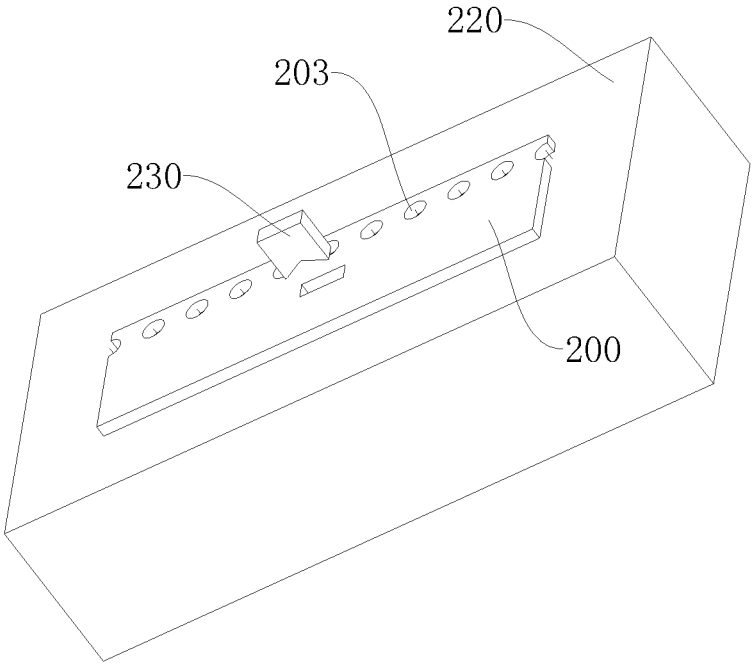
FIG. 12 is a perspective view of a tool suitable for the method for manufacturing the power interface according to an embodiment of the present disclosure.
Figure 13:
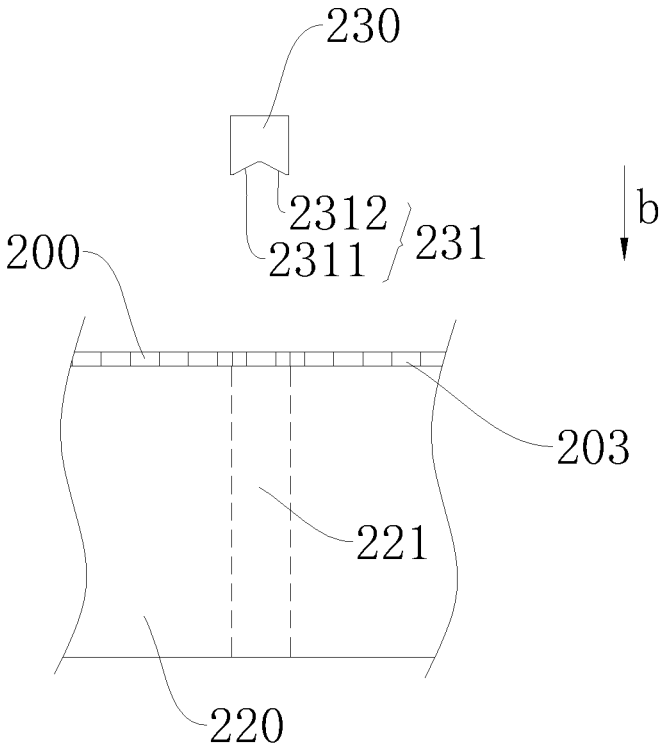
FIG. 13 is a partial view of a tool suitable for the method for manufacturing the power interface according to an embodiment of the present disclosure.

According to an embodiment of the present disclosure, as shown in FIGS. 11-13, the second mold 230 may include an end surface oriented towards the first mold 220, which is served as a punching shear surface 231. A middle portion of the punching shear surface 231 may be recessed in a direction far away from the first mold 220. In this way, it is possible to reduce the burrs formed in the punching shear process of the power pin 120. More specifically, the punching shear surface 231 may include a first inclined surface 2311 and a second inclined surface 2312 joined with the first inclined surface 2311. The first inclined surface 2311 and the second inclined surface 2312 may be gradually inclined in a direction from an edge of the punching shear surface 231 to the middle portion and away from the first mold 220. In this way, tips may be formed at the edges of the punching shear surface 231, and thus it is possible to effectively reduce the occurrence of the burrs during the punching shear process.

A mobile terminal according to an embodiment of the present disclosure, may include a power interface 100, which may be the power interface 100 manufactured by the above methods. The mobile terminal may achieve a transmission of the electrical signals and data signals via the power interface 100. For example, the mobile terminal may be charged or achieve the data transmission function by electrically connecting the power interface 100 to a corresponding power adapter.

In the mobile terminal according to the embodiment of the present disclosure, different surfaces of the workblank 200 are processed by means of fine blanking. In this way, it is possible to not only improve the manufacturing accuracy of the power pin 120, but also omit the process of removing the burrs. Thus, the manufacturing cycle of the power interface may be shortened, and the manufacturing cost thereof may be saved.

In the power adapter according to an embodiment of the present disclosure, the power adapter may include the power interface 100 as described in the embodiments above. The power adapter may achieve a transmission of the electrical signals and data signals via the power interface 100.

In the power adapter according to the embodiment of the present disclosure, different surfaces of the pin workblank 200 are processed by means of fine blanking. In this way, it is possible to not only improve the manufacturing accuracy of the power pin 120, but also omit the process of removing the burrs. Thus, the manufacturing cycle of the power interface may be shortened, and the manufacturing cost thereof may be saved.

Reference throughout this specification, the reference terms "an embodiment", "some embodiments", "one embodiment", "another example", "an example", "a specific example", or "some examples", and the like means that a specific feature, structure, material, or characteristic described in connection with the embodiment or example is included in at least one embodiment or example of the present disclosure. Thus, the illustrative descriptions of the terms throughout this specification are not necessarily referring to the same embodiment or example of the present disclosure. Furthermore, the specific features, structures, materials, or characteristics may be combined in any suitable manner in one or more embodiments or examples. In addition, one skilled in the art may combine the different embodiments or examples described in this specification and features of different embodiments or examples without conflicting with each other.

Although explanatory embodiments have been shown and described, it would be appreciated by one skilled in the art that the above embodiments previously described are illustrative, and cannot be construed to limit the present disclosure. Changes, alternatives, and modifications can be made in the embodiments without departing from scope of the present disclosure.

The invention claimed is:

1. A method for manufacturing a power pin of a power interface, comprising steps of:

providing a pin workblank, wherein the pin workblank comprises a first surface and a second surface adjacent to each other;

performing a fine blanking process for the first surface in a predetermined blanking direction, while burrs forming on the second surface; and adjusting a position of the pin workblank, and performing another fine blanking process for the second surface in the predetermined blanking direction, to form the power pin of the power interface, and to omit a process of removing the burrs on the second surface, wherein prior to the adjusting a position of the pin workblank, and the performing another fine blanking process for the second surface in the predetermined blanking direction, the method further comprising:

forming a chamfer or a round fillet at an edge of the second surface adjacent to the first surface of the pin workblank.

2. The method according to claim 1, wherein the power interface is a Type-C interface.

3. The method according to claim 1, wherein the power pin of the power interface is solid, and has a first sidewall surface and a second sidewall surface opposite to the first sidewall surface, the first sidewall surface and the second sidewall surface of the power pin are exposed outside the power interface for being electrically connected to a power adapter.

4. The method according to claim 3, wherein a portion of the power pin between the first sidewall surface and the second sidewall surface is a solid structure.

5. The method according to claim 4, wherein the solid power pin has a cross-sectional area "S" between the first sidewall surface and the second sidewall surface, and the cross-sectional area S is greater than or equal to 0.09805 $mm^2$, and the power pin has a capability of bearing a current not less than 10 A.

6. The method according to claim 5, wherein the cross-sectional area S of the solid power pin is equal to 0.13125 $mm^2$, and the power pin has a capability of bearing a current not less than 12 A.

7. The method according to claim 5, wherein the solid power pin has a thickness D between the first sidewall surface and the second sidewall surface, and the thickness D is substantially same to a thickness of the power interface.

8. The method according to claim 7, wherein the thickness D of the solid power pin is less than or equal to 0.7 mm.

9. The method according to claim 5, wherein the solid power pin has a width W, and the width W is greater than or equal to 0.24 mm and is less than or equal to 0.32 mm.

10. The method according to claim 9, wherein the width W of the solid power pin is equal to 0.25 mm.

11. The method according to claim 3, wherein the method further comprises:

embedding the power pin into a connection body, wherein the first sidewall surface and the second sidewall surface of the power pin are exposed outside the connection body.

12. The method according to claim 11, wherein the connection body comprises a first connection surface and a second connection surface opposite to the first connection surface, the first sidewall surface of each of the power pins exposed outside the connection body is configured as a part of the first connection surface, and the second sidewall surface of each of the power pins exposed outside the connection body is configured as a part of the second connection surface, and the first connection surface and the second connection surface are configured as connection surfaces of the power interface adapted to be electrically connected to the power adapter.

13. The method according to claim 12, wherein the connection body comprises a hard frame and a plastic encapsulation portion, and the step of embedding the plurality of the power pins into the connection body comprises:

arranging the plurality of the power pins into a plurality of receiving grooves of the hard frame respectively;

wrapping the plurality of the power pins and the hard frame by the plastic encapsulation portion, wherein the first sidewall surface and the second sidewall surface of each of the power pins are exposed outside the plastic encapsulation portion.

14. The method according to claim 13, wherein the hard frame has protrusions respectively disposed at two ends of the hard frame which are spaced from each other in a width direction of the hard frame; an end surface of a free end of each of the protrusions is exposed outside the plastic encapsulation portion and configured as a part of an outer surface of the plastic encapsulation portion.

15. The method according to claim 14, wherein the protrusions are located at a front end of the hard frame.

* * * * *